United States Patent [19]

Chalmers et al.

[11] 4,200,517

[45] Apr. 29, 1980

[54] TREATMENT OF HYDROCARBON-CONTAINING MINERAL MATERIAL

[75] Inventors: Franklin S. Chalmers, Bethesda, Md.; Charles A. Czako, Seven Hills; Carl J. Nelson, Lakewood, both of Ohio

[73] Assignee: Arthur G. McKee & Company, Independence, Ohio

[21] Appl. No.: 857,131

[22] Filed: Dec. 5, 1977

[51] Int. Cl.[2] ..... C10G 1/00; C10B 47/20; C10B 1/10; C10B 1/06

[52] U.S. Cl. ..... 208/11 R; 201/32; 202/131; 202/136

[58] Field of Search ..... 201/32; 202/131, 136; 208/11 R, 8 R

[56] References Cited

U.S. PATENT DOCUMENTS

| | | | |
|---|---|---|---|
| 3,227,627 | 1/1966 | Asquini | 201/32 X |
| 3,464,892 | 9/1969 | Bennett | 208/11 R X |
| 3,541,603 | 11/1970 | Tsujihata et al. | 201/32 X |
| 3,560,369 | 2/1971 | Rowland et al. | 201/32 X |
| 3,644,193 | 2/1972 | Weggel et al. | 201/32 X |
| 3,998,703 | 12/1976 | Harrell | 201/32 |
| 4,039,427 | 8/1977 | Ban | 201/32 X |

*Primary Examiner*—Winston A. Douglas
*Assistant Examiner*—William G. Wright
*Attorney, Agent, or Firm*—Pearne, Gordon, Sessions

[57] ABSTRACT

Process and apparatus are disclosed for recovering liquid and gaseous fuel from solid hydrocarbon-containing mineral material such as bitumen-containing mineral materials exemplified by tar sands or oil-bearing diatomites, without expensive pretreatment to separate the hydrocarbon containing material from material containing no hydrocarbon. The hydrocarbon-containing material is agglomerated into discrete pieces that are treated on a traveling grate such as a circular traveling grate and subjected to sequential treatments in which hot gases are passed upwardly or downwardly through a relatively deep permeable bed of the pieces on the grate, in several treating zones separated by transverse gas seals and sealed at the side edges by suitable gas seals. All, or essentially all, of the heat required is obtained in a coke burn-off zone from combustion of coke that remains in the material on the grate after the volatile hydrocarbons have been removed by distillation in an earlier distillation zone. Part of the gas from the distillation zone is continually recycled to pass through the hot material on the grate in a zone following the coke burn-off zone to transfer heat by the gas to the distillation zone and to cool the spent material on the grate before it leaves the grate. Water gas may be produced by passing steam through material containing residual coke, in a treating zone following and preferably near or adjacent the coke burn-off zone. Because of high temperatures in the coke burn-off zone the agglomerated pieces are sintered, and may be glazed, to provide spent pieces that are useful and of economic value.

26 Claims, 17 Drawing Figures

TREATMENT OF HYDROCARBON-CONTAINING MINERAL MATERIAL

BACKGROUND OF THE INVENTION

It has long been known that various solid hydrocarbon-containing mineral materials, such as bitumen-containing mineral materials exemplified by tar sands and oil-bearing diatomites, have great potential as fuel sources. Extensive research has been carried out to develop systems for economical recovery of fuel from such materials. Heretofore, many different systems have been proposed for treatment of such materials, but there has been inadequate incentives for commercial development of these systems because of excessive costs and other drawbacks. In most of the proposed systems, it has been considered important, in the as-mined material, to separate mineral material containing no hydrocarbon from the hydrocarbon containing mineral material to minimize the amount of material being processed; the high cost of effecting the desired degree of such separation has been a major factor in rendering such systems commercially unattractive. Because of such excessive costs, the use of such hydrocarbon-containing materials as sources of oil and gas has not been extensive even though large deposits are known to exist.

Systems have also been proposed employing traveling grates for recovery of oil from oil-bearing shale and other oilbearing materials. However, these systems have had various disadvantages which have discouraged commercial development.

SUMMARY OF THE INVENTION

The present invention provides a simple, effective process for recovery of hydrocarbon products from hydrocarbon-containing material such as tar sands, oil-bearing diatomites, or other hydrocarbon-containing solid minerals of widely varying characteristics, which process does not require extensive pretreatment steps for separation and removal of major amounts of the non-hydrocarbon materials from the hydrocarbon-containing materials and which can effectively treat very large volumes of hydrocarbon-containing material to produce oil and gaseous fuel in a more economical and more reliable manner than previously known processes.

In a preferred process of this invention, the as-mined hydrocarbon-containing mineral material, such as tar sand, which preferably has been separated from barren overburden and which contains free hydrocarbon material such as bitumen, is mixed with recycled solids (spent material) and/or with selected fractions of the as-mined material such as fines, and preferably with an agglomeration-aiding additive and is then agglomerated as by balling or compacting, to form discrete pieces suitable for retorting on a traveling grate in a moving static bed of substantial depth.

These pieces are formed into a gas permeable moving bed of substantially uniform substantial depth in which the pieces are at rest relative to each other, as by being charged onto a suitable traveling gas-permeable grate such as a rotating circular grate having a series of separated controlled temperature heat-treating zones in which hot gases are passed upwardly or downwardly through the permeable bed. The hydrocarbon-containing mineral material pieces in the moving bed are first preheated by recycled hydrocarbon gas and are then subjected to destructive distillation or coking at a higher temperature and under non-oxidizing conditions in a relatively large coking distillation zone heated by recycled hydrocarbon gas. The destructive distillation and coking is carried on for a substantial period of time to obtain the desired amount of distillate materials, which are carried off with the hot gases and then condensed out of the gas stream, and also to obtain manufactured hydrocarbon gas which can be drawn off for use as fuel. A portion of this gas is recycled through the hot spent material in the bed before it is removed from the bed, to cool the bed and the grate or other support for the bed and to transfer heat from the spent material to the recycled gas and from the recycled gas to the material in the bed moving through the coking distillation zone and also if desired from the recycle gas to a prior preheating and distillation zone.

The material leaving the coking distillation zone passes to a coke burn-off zone where an oxidizing gas, such as air or oxygen, is passed upwardly through the bed to maintain combustion to burn coke in the bed and to heat the spent material, which can provide all or essentially all of the heat required for the various steps.

Sealing means, preferably with gas suction, is provided to seal the bed between the coke burn-off zone and the preceding coking distillation zone to isolate the rich fuel gases in the non-oxidizing coking zone from the oxidizing atmosphere of the coke burn-off zone, to provide more uniform treatment of the material in the bed passing through each zone, and to prevent accidents due to ignition of combustible gases in the coking zone. Preferably, at least a major portion of the seal leakage gas from this sealing means can be pumped to the burn-off zone.

In the preferred embodiment of the invention the traveling grate apparatus includes a preheat distillation zone, a coking distillation zone, a coke burn-off zone, a recycle gas heat zone for heating hydrocarbon gases being recycled to said coking distillation zone, and a recycle gas recuperator zone for heating gases being recycled to said preheat distillation zone. If hot residual material leaving the burn-off zone in the bed still contains an appreciable portion of coke, such coke can, if desired, be recovered as useful fuel by reacting it with steam passed through the bed of such material in a gasification zone to produce a gas comprising a mixture of carbon monoxide and hydrogen. Such steam can also effect hydrogenation of any residual oil in the coke. The cooling effect of the steam also aids in preventing damage to the grate from overheating, particularly if the steam is raised upwardly through the grate and bed.

The distillate from the coking distillation zone is removed from the gas stream by a direct contact cooler and a suitable mist separator, and water can be separated from the oil in the distillate using suitable decanters and a suitable emulsion breaker. Condensing of the hydrocarbon distillates by recirculating water is economical and effective, and the use of water separation means permits use in the traveling bed of hydrocarbon-containing materials of widely varying characteristics including those containing substantial moisture. If the material contains substantial amounts of water, part of such water can react with the hydrocarbon and/or hot coke in the coking zone and the remaining water can be separated from the oil distillate after condensation.

The various treating zones through which the bed travels as on traveling grate apparatus are separated by suitable transverse seals, and where a circular grate is used are preferably sealed at the inner and outer circumference of the grate by liquid seals. The seals minimize heat losses and gas leakage between zones and facilitate control of the temperature and the pressure in each zone and more uniform treatment of the material. They make it possible to employ high temperature hydrocarbon gases without danger of fire or explosion due to air leakage.

The pieces of agglomerated material are preferably heated in the bed in the coke burn-off zone to a temperature at which incipient fusion of the particles of material appears to occur, from about 1500° F. to about 2300° F. or higher, in order to increase the strength of the agglomerated pieces or to effect glazing or both. Such high temperature treatment produces both an effective heat transfer medium to heat the recycled gas, and a useful saleable agglomerated spent material that can be used, for example, as a substitute for gravel or crushed stone and that overcomes dust control and environmental waste disposal problems otherwise inherent in similar spent or residual material which has not been agglomerated and so heated to fusion temperatures.

DESCRIPTION OF THE PREFERRED EMBODIMENTS

While the invention may be employed for processing various kinds of hydrocarbon containing mineral materials such as those mentioned above to recover liquid and gaseous materials, it will be disclosed hereinafter as used in processing tar sand, with which it provides particular advantages.

Figure 1:
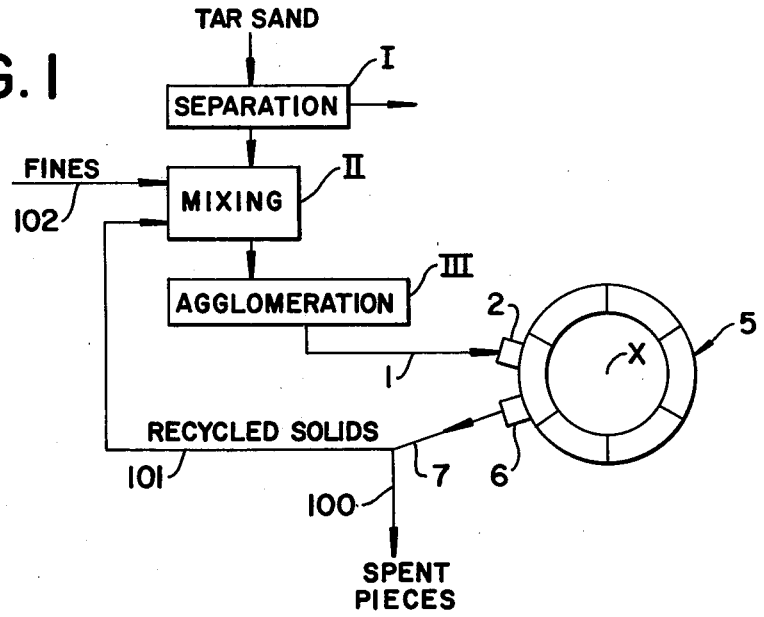
FIG. 1 is a diagrammatic plan view to a small scale of a preferred form of apparatus for treating agglomerated tar sand pieces according to the present invention.
Figure 2:
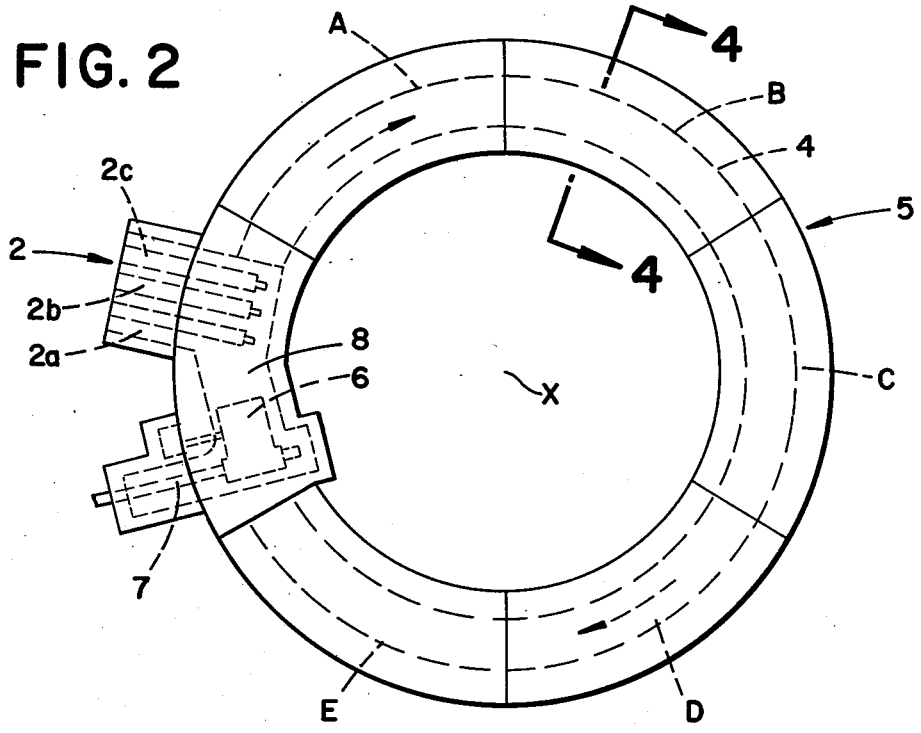
FIG. 2 is a diagrammatic plan view of the traveling circular grate apparatus portion of the apparatus of FIG. 1, parts being broken away.
Figure 3:
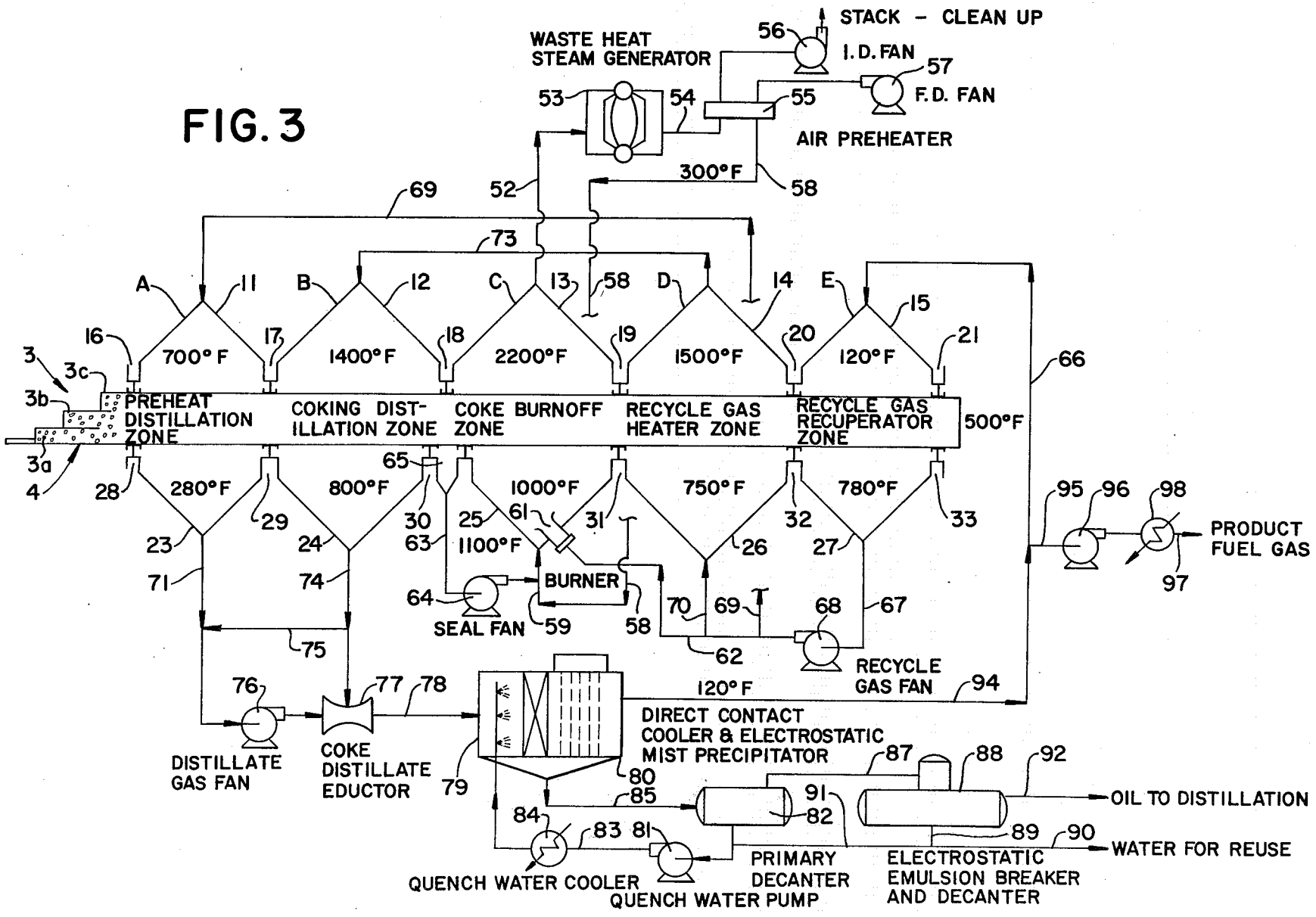
FIG. 3 is a diagrammatic extended side view of the circular grate portion of the apparatus of FIGS. 1 and 2 but to a larger scale, diagrammatically illustrating the process of the invention and other equipment used with such circular grate portion.

One embodiment of the invention is illustrated diagrammatically in FIGS. 1 to 3. As indicated in FIG. 1 any barren overburden portion of as-mined tar sand entering the system at Station I in a known manner is separated from the tar sand, and then the tar sand is preferably mixed in Statin II with recycled solids from the process such as spent sand or selected fractions of the as-mined tar sand fines and preferably with an agglomeration-aiding additive. Thereafter in Station III, the mixture is formed into discrete pieces as by known agglomeration processes such as balling or compacting under pressure, or by crushing and grading, to form pieces having adequate resistance to decrepitation spalling or disintegration during subsequent processing and having adequate permeability for treatment on traveling grate apparatus. Preferably, the pieces have maximum cross sectional dimensional dimensions of between about ⅛ inch and 3 inches, pieces having a cross section of about ⅝ inch being preferable.

Preferably, the tar sand or other hydrocarbon containing mineral material while in particulate form is mixed in Station II with a small amount (preferably 0.5 to 10 percent by weight) of an agglomeration-aiding additive such as bentonite, hydrated lime, mined oil-saturated diatomite, or metallurgical coal or other suitable carbonaceous material, and then agglomerated as by being mixed with water and balled on a balling disc or drum, or by being compacted in known apparatus under suitable pressure, to form discrete pieces or pellets having adequate green strength to permit subsequent large scale treatment of large volumes of the agglomerated material in a bed of substantial depth. Compacting pressures of from 500 to 5500 pounds per square inch in g neral are preferable, depending on the type of mineral material.

The tar sand pieces are then passed from Station III by suitable known conveyor means 1 to feed means 2 that deposits them in a bed 3 on a traveling grate 4 of apparatus 5 which may be a known type of circular grate apparatus similar to that disclosed in U.S. Pat. Nos. 3,460,818 or 3,589,691. The tar sand pieces are distributed in known manner by known means to form a bed 3 of substantially uniform depth on grate 4 as it travels. If desired, the bed may consist of three superposed layers 3*a*, 3*b*, 3*c* as shown in FIG. 3. Hearth layer 3*a* may be recycled depleted tar sand pieces, or could be quartz pebbles or other refractory material specifically selected for such use. Layers 3*b* and 3*c* may be agglomerated tar sand pieces of different sizes, the larger pieces being in the lower layer. However, if the agglomerated tar sand pieces are of substantially the same size, the bed preferably consists of one layer. Of course, beds of other numbers of layers can be used.

In the illustrated embodiment, hearth layer 3*a* may be spread as required on the grate 4 by feed means 2*a*, and the tar sand pieces are spread on the grate 4 in two layers 3*b* and 3*c* by known feed means 2*b* and 2*c*. Each of feed means 2*a*, 2*b* and 2*c* may be of the type disclosed in U.S. Pat. No. 3,184,037 comprising a belt conveyor having a reciprocating discharge end that moves radially across the width of the grate, the speed of reciprocation of the discharge end of the conveyor belt being related to its distance from the center of rotation of the grate to cause such belt to lay down a level bed of pieces on grate 4 as it moves. The feed means lays the tar sand and hearth layer pieces on the grate in such manner that the moving bed 3 in which the pieces are at rest relative to each other has a generally uniform depth and is permeable to vertical gas flow in various process zones. A bed depth of about 6 to about 30 inches or even more is preferred, so that large volumes of material can be treated.

The traveling grate apparatus 5 of FIGS. 1 to 4 preferably comprises grate 4 that is circular in plan and travels in a circular path to carry the bed 3 of tar sand pieces through five process zones A, B, C, D, and E (FIGS. 2 and 3) in which the tar sand material in the pieces in bed 3 is subjected to the treatments described later. After treatment the pieces are removed from the grate by discharge means 6 and deposited on known conveyor means 7 for disposition as hereinafter described. The discharge means 6 is known and preferably like that described later, which lifts the heated pieces off the grate and discharges them onto conveyor means 7. Part of the treated pieces may be left on the grate to form all or part of a hearth layer 3*a* of desired thickness.

Both the feed means 2 and the discharge means 6 in the illustrated embodiment are enclosed in gas tight enclosure means 8 provided with known gas lock means, not shown, at the location where conveyor 1 enters the enclosure means and at the location where conveyor means 7 discharges the treated pieces from the enclosure means.

As illustrated diagrammatically in FIG. 3, grate apparatus 5 comprises stationary hoods 11, 12, 13, 14, and 15 respectively located above the grate at zones A, B, C, D and E, and having gas tight end and intermediate seal portions 16, 17, 18, 19, 20 and 21 with associated sealing means as described hereinafter. Stationary lower gas enclosures 23, 24, 25, 26, and 27 respectively associated with hoods 11 to 15 in zones A to E are provided under the grate and have end and intermediate seal portions 28, 29, 30, 31, 32 and 33.

The circular traveling grate 4 (FIG. 4) has a known gas permeable hearth 35 and upstanding side walls 36 and 37 extending around the outer and inner circumferences of the grate. The grate is fixed to a generally circular rigid frame 38 rotatable about vertical axis X, so that the grate and its frame travel in a circular path. Frame 38 carries circular rails 39 that ride on and are supported by rollers 40 rotatably supported from a rigid stationary frame 41. At least some rollers 40 are driven from suitable known power means 42.

It is important that the traveling grate apparatus 5 embody means for maintaining proper gas pressures in the treating zones and preventing leakage of gas between the zones or the sides of the grate 4.

Suitable transverse sealing means such as that described later are located at the end and intermediate seal portions above and below the grate to form transverse seals that prevent harmful lateral flow of gases between and out of the zones. Hoods 11 and 15 and end enclosures 23 and 27 are connected gas tight to enclosure means 8 that encloses feed means 2 and discharge means 6.

The side sealing means illustrated is similar to that described in U.S. Pat. Nos. 3,460,818 and 3,589,691. To seal grate 4 to the hoods above the grate, annular channel shaped troughs 44 and 45 (FIG. 4), containing water or other suitable liquid at a suitable maintained level, are fixed in gas tight relation to the grate 4 immediately adjacent the outer and inner walls of the grate and carried by the rigid frame 38. Shield walls 46 and 47 extend downwardly of the sides of the hoods into the liquid in troughs 44 and 45; these walls preferably extend continuously throughout the lengths of all of the hoods and their intermediate positions, preferably being connected at the ends of the hoods to transverse baffle members in the troughs that prevent escape of gas past the ends of the hoods.

To seal grate 4 to the gas enclosures below the grate, stationary troughs 48 and 49 are provided below the traveling grate in gas tight relation to the inner and outer walls of gas enclosures 23 to 27 and their intermediate portions, and extend around the circumference of the apparatus for at least the distance occupied by these enclosures and portions. Each trough contains suitable liquid maintained at a suitable level. Downwardly extending shield walls 50 and 51, fixed in gas tight relation to the bottoms of the upper troughs 44, 45 and hence to the side walls of grate 4, have their lower ends immersed in the liquid in the associated troughs 48 and 49.

Therefore, as the traveling grate 4 moves in its circular path about axis X, the upper troughs 44 and 45 travel with it while upper shield walls 46 and 47 remain stationary and by projection into the liquid effectively seal the sides of the hoods against escape of hot gas or ingress of ambient air; and the inner shield walls 50 and 51 travel with the grate and extend into the liquid in lower troughs 48 and 49 and seal the sides of the lower enclosures below the grate against escape of hot gases or ingress of ambient air.

A preferred embodiment of the process of this invention utilizing a traveling grate, which may be circular grate 4 in apparatus 5, as illustrated diagrammatically in FIG. 3. FIG. 3 is an expanded view of the grate apparatus with certain structural parts omitted; it will be understood that various conduits for carrying gases and liquids would be arranged to fit the appropriate portions of that apparatus.

As shown in FIG. 3 the bed of agglomerated pieces of tar sand carried by the circular grate passes sequentially through five controlled temperature process zones A through E. The bed is permeable so that gases can flow upwardly or downwardly through the bed in order to effect the desired heat transfer and reactions.

Hood 11 and its associated lower gas enclosure 23 define a preheat distillation zone A in which the agglomerated tar sand pieces in the bed on the traveling grate are first subjected to preheating by hot gases passing downdraft through the bed. Next adjacent hood 12 and its associated lower enclosure 24 define a coking distillation zone B in which volatile material in the tar sand pieces are next distilled by hot gases passing downdraft through the bed. The next hood 13 and its associated lower gas enclosure 25 define a coke burnoff zone C into which the bed next passes and in which combustion is supported by air passing updraft through the bed, thereby providing all or substantially all of the process heat requirements. The next hood 14 and its associated enclosure 26 define a recycle gas heater zone D in which recycle gas passes updraft through the hot bed of tar sand pieces to receive heat from the hot tar sand pieces and to cool the pieces and the grate. The last hood 15 and its associated enclosure 27 between which the bed passes define a recycle gas recuperator zone E wherein the recycle gas passes downdraft through the bed to receive heat from the partially cooled tar sand pieces and to provide further cooling of the treated tar sand pieces of the bed before they are discharged by means 6.

Residual coke in the bed of tar sand pieces provides fuel for process heat requirements. All or substantially all of the necessary heat can be obtained by combustion in the coke burnoff zone C of the coke or carbonaceous material; this further heats the tar sand pieces and thus provides heat which can be transferred to the recycled gas and for the purposes described above. The hot gases from the coke burn-off zone pass upwardly from its hood 13 through a conduit 52 to a known waste-heat steam generator 53 which cools the gases somewhat while recovering heat energy as useful steam. The still heated gases from unit 53 discharge in conduit 54 through an air preheater 55 to a fan 56 which discharges the cooled gases to a stack or suitable clean-up apparatus.

Heat from the gases in conduit 54 is transferred by preheater 55 to air forced through that unit by fan 57. The thus preheated air passes through conduit 58 to an air inlet conduit 59 at the bottom of gas enclosure 25 from which it moves upwardly through the bed in the burn-off zone C to maintain combustion that heats the pieces in the bed to provide process heat requirements for most if not all the treating zones along the grate.

To initiate or supplement combustion in the zone C, means may be provided such as a burner 61 having known igniting means. Burner 61 is shown as located near the bottom of the enclosure 25 and supplied with recycled hydrocarbon gas through conduit 62.

Leakage of oxygen-bearing gas from enclosure 25 into the adjacent lower enclosure 24 is prevented by withdrawing gas by a conduit 63 and fan 64 from a transverse seal 65, to be described later, that seals the portion 30 between enclosures 24 and 25 to the grate 4. This withdrawn gas, which may contain oxygen, when mixed with air from conduit 59 helps maintain combustion in enclosure 25.

The hot pieces leaving the burn-off zone C subsequently give up heat in zones D and E to recycle process gas, the recovering heat which is transferred to the material entering zones A and B. Thus, process heat losses are compensated for and the temperature of the pieces of agglomerated spent tar sand is reduced before the pieces are removed from the grate by discharge means 6.

As shown in FIG. 3, recycled hydrocarbon-containing fuel gas from conduit 66 moves downdraft through the bed of spent pieces in the recycle gas recuperator zone E and is heated as it cools the spent pieces in the bed. The resulting heated gas, at a temperature in excess of about 500° F., is drawn through conduit 67 by fan 68 which forces a major portion of the gas through conduits 69 and 70, and a minor portion of the gas to conduit 62. The preheated gas from conduit 69 preferably has a temperature of from about 650° F. to about 850° F. and passes downdraft through the portion of the bed in the preheat distillation zone A to heat the bed under non-oxidizing conditions while evaporating a portion of the volatile material. The bed is thus preferably preheated by the gas to an average temperature of from about 250° F. to about 700° F. The distillate flows downwardly with the gas to the bottom of enclosure 23 and is removed through conduit 71.

The remaining volatile material is removed from the pieces in the bed in a similar manner in the coking distillation zone B whic is maintained at a substantially higher temperature by recycled hydrocarbon gases from the recycle gas heater zone D.

A portion of the preheated gas from conduit 67 is forced by fan 68 through conduit 70 into enclosure 26 and then upwardly through the portion of the bed in the zone D to increase the temperature of the gas materially, preferably to a temperature of from about 1300° F. to about 1700° F., and to partially cool the agglomerated tar sand pieces. This gas then passes from hood 14 through conduit 73 to hood 12 of zone B. This gas, the temperature of which is preferably at least 1200° F., is passed downwardly through the portion of the bed in the zone B to further heat the pieces in the bed to an average temperature of about 750° F. to about 1500° F. and, for tar sand, preferably to an average temperature of at least about 1000° F., and to remove from the pieces the remaining volatile materials which are carried downwardly with the gas to the bottom of enclosure 24 and outwardly through the discharge conduit 74.

Fuel product recovery of most of the liquid and gaseous fuel from the system occurs in distillation zone B, but substantial additional recovery of product can also occur in zone A. Therefore, if desired, branch conduit 75 may be provided for connecting conduits 71 and 74. Suitable means are provided for delivering the hot gases and distillate from conduits 71 and 74 to suitable treating apparatus and for maintaining a subatmosphereic pressure in these conduits. As illustrated, a distillate gas fan 76 is provided to force the gases and distillate at high velocity through the coke distillate eductor 77 and through a conduit 78 to suitable treating apparatus where the gas stream is cooled to a temperature below 200° F. The eductor may be a known ejector and provides suction in conduit 74 to assist in pumping the gases out of zone B.

Various means may be employed to condense the distillate from conduit 78 and to separate the condensible liquids from the hydrocarbon gases. In the system illustrated the condensing means comprises a known direct contact cooler 79 and a known electrostatic mist precipitator 80. Cooling water is continuously circulated by a known quench water pump 81 which delivers water from a known primary decanter 82 through conduit 83 to spray heads in the cooler unit 79, the water being cooled to the desired temperature by a known water cooler 84. The water is sprayed directly into the chamber of the unit 79 for admixture with the hot gases. Excess water is collected in the bottom of unit 79 and carried by the conduit 85 to primary decanter 82 for preliminary separation of the water and oil. The water, heavier than the oil, is drawn off through conduit 83 for recycle by pump 81 through cooler 84 to cooler unit 79.

The oil phase is removed from the decanter 82 through conduit 87 and is delivered to a known electrostatic emulsion breaker and decanter 88 which separates out the remaining water and delivers it through conduit 89 to conduit 90 for discharge of net water produced in the process. Water balance in the water recirculator part of the system is maintained through conduit 91 connected between conduits 83 and 89. The remaining essentially water-free product oil in the unit 88 is delivered through conduit 92 to another location for subsequent processing by hydrogenation or other techniques into the desired spectrum of hydrocarbon products. Other types of equipment may be employed for separating the water from the oil.

Unit 79 discharges warm hydrocarbon gas through conduit 94 which communicates with conduit 66 and with conduit 95 connected to blower 96 that delivers product fuel gas through conduit 97 to a point of storage or use. The major portion of the gas from conduit 94 is recycled through conduit 66 as described previously. If desired, a cooler 98 may be provided for cooling and removing water vapor from the product gas delivered through conduit 97.

After the spent agglomerated sand pieces on the portion of the bed located at zone E leave that zone, they are discharged from the grate by the discharge means 6 to a conveyor means 7. As indicated in FIG. 1, a major portion of the spent pieces from conveyor means 7 is removed by conveyor means 100 and a minor portion of the pieces is recycled as indicated by conveyor means 101 for mixing with the incoming material at mixing Station II. The recycling of solids is optional, and it will be understood that as-mined fines may be added by conveyor means 102 to Station II, if desired.

As a more specific example of a process of the invention performed on tar sand pieces in a system like that of FIGS. 1 to 4, the system is designed to heat the incoming tar sand pieces from the ambient temperature at which they enter to an average temperature of above about 480° F. as they leave zone A, by hot recycle gases entering zone A from conduit 69 to maintain a temperature of about 700° F. in enclosure 11 above the grate and a temperature of about 280° F. in enclosure 23 below the grate in zone A. The tar sand pieces entering the coking distillation zone B are heated by recycle gases at temperatures of about 1500° F. emanating from zone D, to maintain a temperature of about 1400° F. in enclosure 12 above the grate and a temperature of about 800° F. in enclosure 24 below the grate in zone B, while heating the tar sand pieces from an average temperature of about 590° F. at the entrance of zone B to a temperature of about 1250° F. at the exit end of zone B from which they enter the succeeding coke burn-off zone C.

In the system of this example, moreover, the preheated air fed to enclosure 25 below the grate in zone C is delivered through conduit 58 at a temperature of about 300° F. and the temperature of the oxygen containing air or gas in enclosure 25 is raised and maintained in the vicinity of 1000° F. by combustion of fuel gas introduced through conduit 62 to burner 61. Combustion of residual coke in the pieces in the bed passing through zone C in the presence of the oxygen-containing gas provided from the lower enclosure 25 raises the average temperature of the pieces in the bed to the temperature of incipient fusion, or about 2200° F. within enclosure 13 above the grate in zone C. Moreover, in a system of this type, the temperature of the gases drawn off through conduit 63 from sealing means 65 can be, for example, above about 1100° F. due to combustion of fuel gas leaking from enclosure 24 of zone B and burned in oxygen containing gas leaking from enclosure 25 of zone C.

The spent hot pieces in the bed at an average temperature of about 2200° F. in recycle gas heater zone D give up heat to recycle gas entering enclosure 26 below the grate in zone D at a temperature of about 750° F. to raise the temperature of the gas to about 1500° F. The thus heated gas passes to the coking distillation zone B as described above to coke and distill the tar sand pieces in zone B. The average temperature of the pieces in the bed leaving zone D is then about 1000° F. to 1400° F.

The pieces in the bed entering recycle gas recuperator zone E are cooled from an average temperature of about 1000° F. to 1400° F., to about 500° F. or less as they leave the zone, by gas from conduit 66 at a temperature of approximately 120° F. As such gas passes through the bed it is heated by heat from the hot tar sand pieces to about 780° F. As indicated previously a portion of the gas from zone E passes to the preheat distillation zone A where it preheats the entering tar sand pieces; a portion passes to the recycle gas heater zone D in which it picks up heat from the tar sand pieces to raise its temperature sufficiently to cause coking and distillation in zone B; and a minor portion provides fuel for burner 61 in zone C.

Thus, in the above system, the considerable sensible heat content of the spent tar sand pieces leaving the coke burn-off zone C, which pieces have been heated in that zone to incipient fusion, can furnish substantially all process heat required in all other zones including zones A and B.

The hot gases leaving the distillation zones A and B are at relatively high temperatures; substantial cooling is provided in the cooling unit 79. In the example described above, satisfactory operation is effected with the gases cooled to provide a gas temperature of about 120° F. of the gases passing through conduit 94 and recycle conduit 66. The gases discharged as product can be further cooled by cooler 98 to a considerably lower temperature and moisture content after compression by blower 96.

Figure 5:
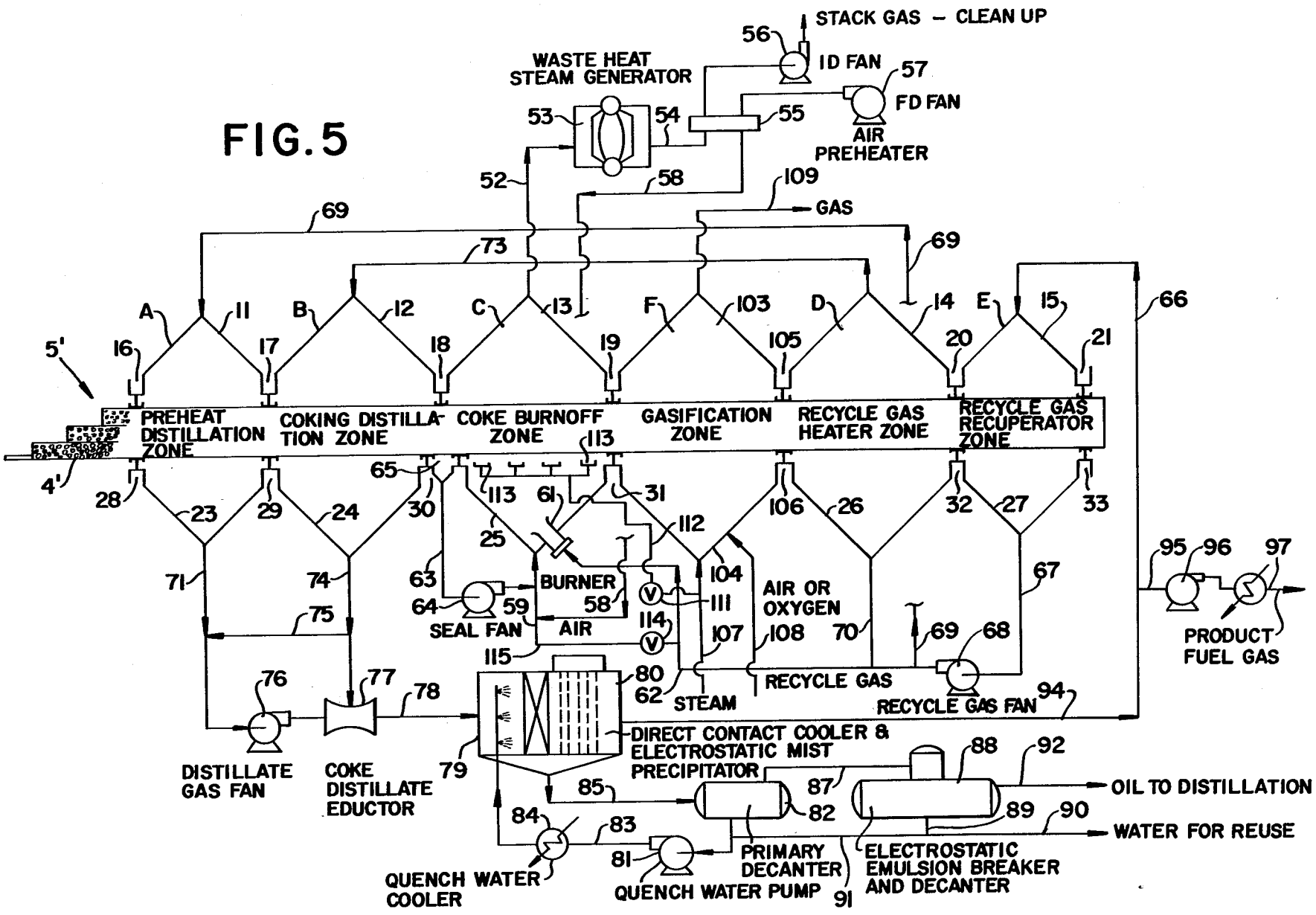
FIG. 5 is a view similar to FIG. 3 and to the same scale, but illustrating a different embodiment of the invention including on the grate a gasification zone for removing excess carbonaceous material from the pieces after they leave the coke burn-off zone.

FIG. 5 illustrates another embodiment of the invention in which a gasification zone is provided on the circular grate 4' of modified circular grate apparatus 5' that is similar to that previously described. The moving bed of hot agglomerated pieces moves through the gasification zone after leaving the coke-burn-off zone. The gasification zone may be advantageously used in the treatment according to the invention of certain tar sands or other bituminous materials that produce in the agglomerated pieces on distillation excessive amounts of coke that is not removed in the coke burn-off zone.

The embodiment of FIG. 5 is similar to that of FIG. 3, like parts bearing like reference numerals, except that the embodiment of FIG. 5 includes a gasification zone F between coke burn-off zone C and recycle gas treating zone D for treating the hot agglomerated sand pieces leaving the coke-burn-off zone C to produce a useful fuel gas from coke remaining in such pieces. The zone F comprises hood 103 above the grate and gas enclosure 104 below the grate, hood 103 being separated from adjacent hoods 13 and 14 by sealing portions 19 and 105, and enclosure 104 being separated from adjacent enclosures 25 and 26 by sealing portions 31 and 106. As shown in FIG. 5, steam from a suitable source is supplied to lower enclosure 104 from conduit 107 and is caused to pass upwardly by known means not shown through the hot agglomerated tar sand pieces on the grate passing through zone F, to react with coke in such pieces to form water gas consisting principally of hydrogen and carbon monoxide, and to cause hydrogenating of any remaining oil in such pieces. Oxygen, air, or other oxygen-containing gas may also be introduced into enclosure 104 through conduit 108 to aid in controlling the reaction. The water gas and other fuel gas from the gasification zone F is discharged from hood 103 through conduit 109 which delivers it to the storage or use location.

Zone F should be located relative to the coke burn-off zone C so as to maintain in the bed while in zone F a suitable temperature for the water gas reaction and for providing effective hydrogenation of any oil remaining in the pieces in the bed, and to protect the grate against damage by overheating. However, use of such a gasification zone on the grate can be advantageous even if such zone is located at a position different from that shown in FIG. 5, as for example, between zones D and E, or after zone E, if the material in the bed contains substantial amounts of coke after distillation and burn-off.

The average temperature of the bed in the gasification zone used should be in excess of 1200° F. and is preferably from about 1500° F. to about 2000° F.

As shown in FIG. 5, a portion of the steam from conduit 107 can be passed through control valve 111 and conduit 112 to nozzle 113 located below the grate in enclosure 25 of burn-off zone C to aid in removing coke in that zone. Another portion can be passed through control valve 114 and conduit 115 into air supply conduit 59 and thus into the coke burn-off zone.

Figure 6:
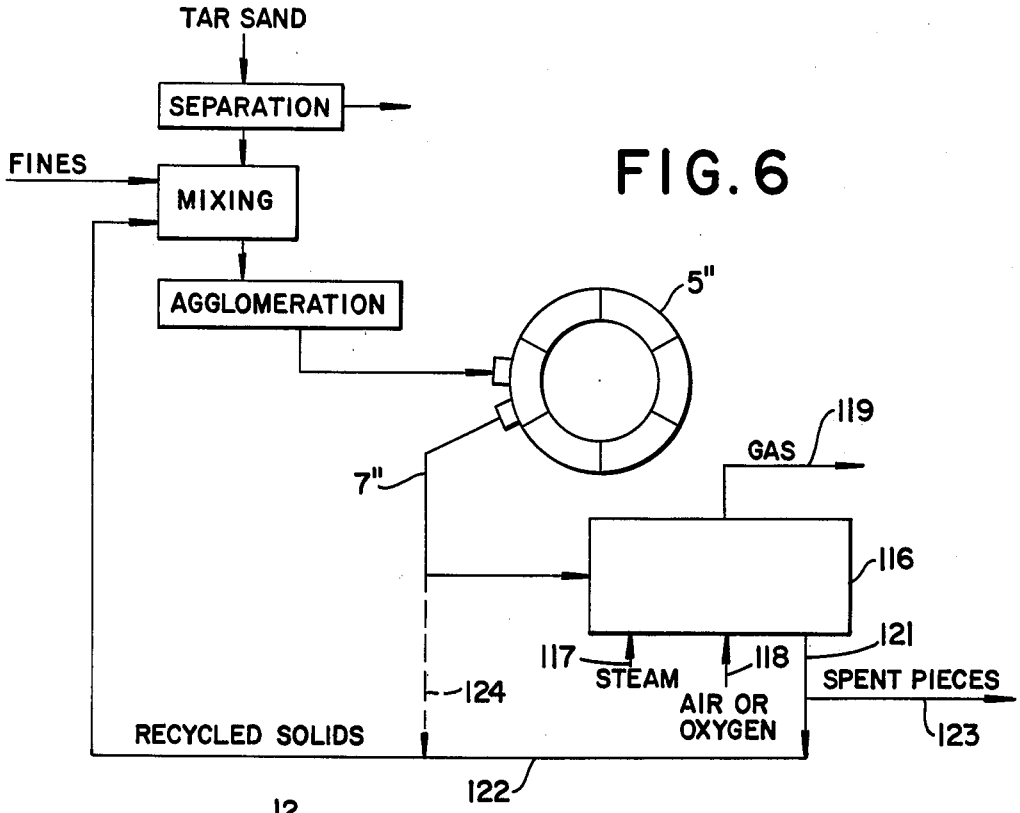
FIG. 6 is a plan view similar to FIG. 1 but embodying a separate gasification unit for removing excess carbonaceous material.
Figure 4:
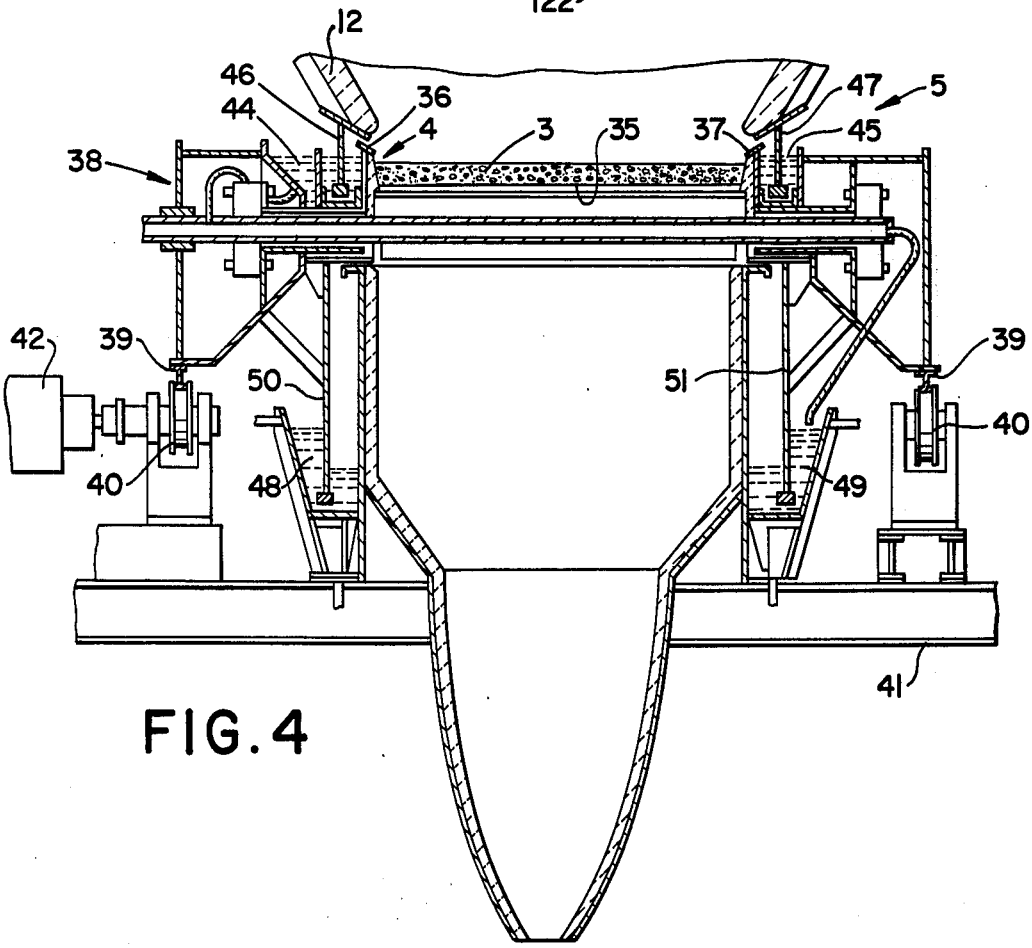
FIG. 4 is a cross section along line 4-4 of FIG. 2 but to a larger scale showing a form of circular grate apparatus that may be used in carrying out the process of the invention.

Furthermore, if desired, gasification to consume excess coke remaining in the pieces after distillation and coke burn-off may be effected off the grate, as illustrated in the embodiment of FIG. 6 in which hot agglomerated pieces of sand containing coke are discharged from grate apparatus 5″ similar to that described above in connection with FIGS. 1–4, preferably without cooling, and passed by conveyor means 7″ to gasification unit 116, preferably a conventional shaft kiln unit, in which the pieces are subjected to steam supplied through conduit 117, and to oxygen bearing gas such as air or high purity oxygen supplied through conduit 118. The low BTU fuel or water gas resulting from the decoking reaction is discharged through conduit 119, and the spent agglomerated pieces are discharged through a conveyor means 121, a minor part, if desired, being recycled back through conveyor means 122 through treating Station II for reuse, and a major part discharged through conveyor means 123 for storage or use. If desired, part of the spent pieces discharged from the grate can also be directly discharged from discharge conveyor means 7″ onto by-pass conveyor means 124 to be directly recycled.

In general, the need to employ such a gasification zone or unit depends primarily upon the characteristics of the particular tar sand or other bituminous material charged into the process.

From the above, it is apparent that it is important to provide effective means extending transversely of the grate for sealing adjacent process zones from each other and for preventing leakage at the ends of the sequence of hoods and lower gas enclosures. Effective seals at these locations and at the sides of the grate as described above, prevent or minimize harmful leakage between zones, provide more uniform temperatures throughout the width of the bed, and make it possible to employ high temperature reducing gases without danger of fire or explosion.

Figure 7:
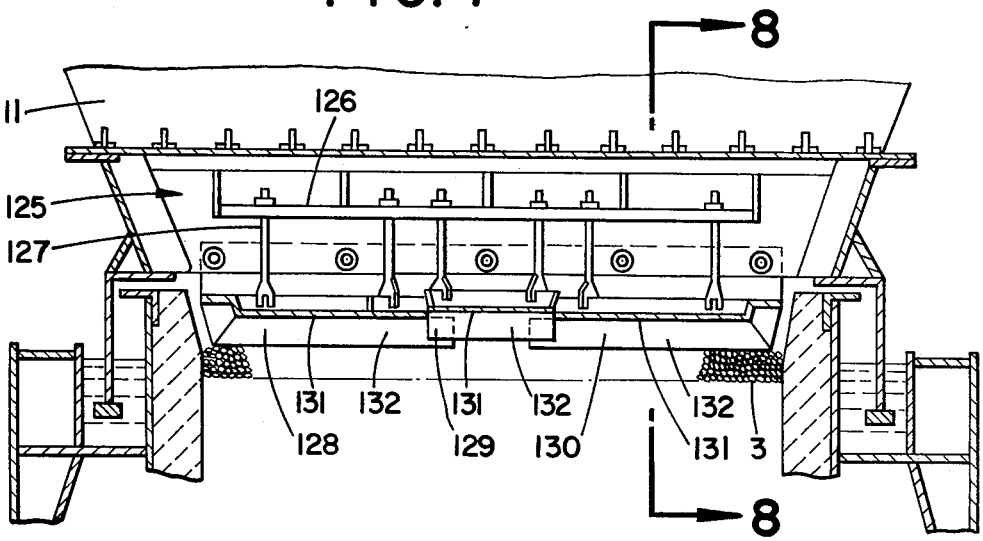
FIG. 7 is a fragmentary section transverse to the grate apparatus but to a larger scale, showing a form of sealing means that may be used at the entrance of the first zone.
Figure 8:
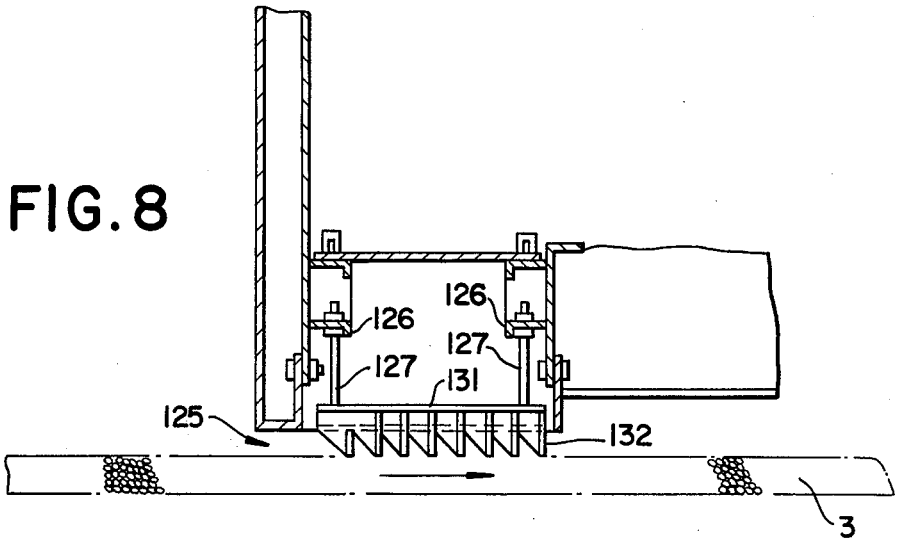
FIG. 8 is a fragmentary view of the sealing means of FIG. 7 from line 8—8 of FIG. 7.

FIGS. 7 and 8 illustrate sealing means 125 which may be used in the previously described circular grate apparatus at the sealing portions 16 at the entrance of the grate into the gas enclosure hood 11 above the grate and at the sealing portion 21 at the exit from hood 28 in FIGS. 3 and 5. Sealing means 125 illustrated in these figures is supported by cross members 126 fixed to hood 16 and extending substantially across the grate. Supporting rods 127 depending from the cross members support three overlapping transverse sections 128, 129 and 130 of the sealing means so their height can be adjusted. Each section comprises a top plate 131 carrying downwardly depending baffle vanes 132 that closely approach the top of the bed 3 moving thereunder. The three sections of the seal are constructed are arranged so that their baffle vanes extend horizontally substantially across the hearth and present a tortuous path for any gas or air passing into or out of the hood 11. Sealing means 125 may also be employed with hoods other than the hood 11 as at the exit end of the hood 15 of zone E. Various other types of transverse seals could, of course, be employed at these locations.

Figure 9:
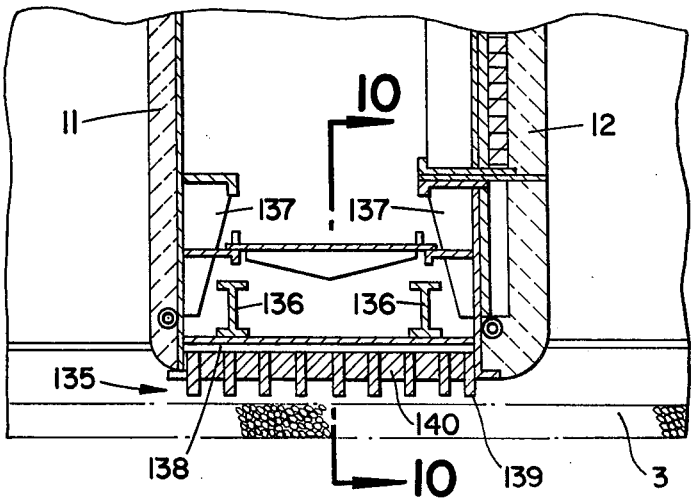
FIG. 9 is a fragmentary cross section of a form of sealing means that may be used above the grate and the bed of material thereon, between two enclosures above the grate of adjacent zones.
Figure 10:
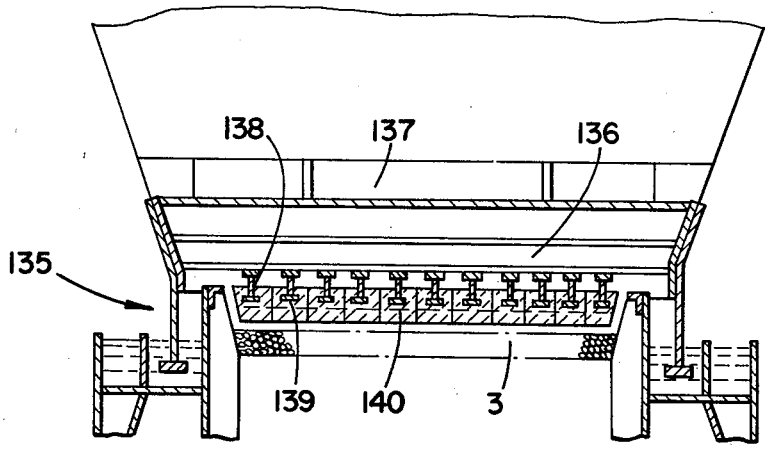
FIG. 10 is a fragmentary view of the apparatus of FIG. 9 and to the same scale, from line 10–10 of FIG. 9.

Another desirable transverse sealing means that can be used adjacent the top of the bed on the grate and preferably between adjacent gas enclosures or hoods above the grate is illustrated in FIGS. 9 and 10. These illustrate transverse sealing means 135 located immediately above the bed in the sealing portion 17 between adjacent hoods 11 and 12; such sealing means may also be provided between other hoods above the grate.

Sealing means 135 is carried by rigid beams 136, fixed to intermediate portions 137 carried by adjacent hoods, and extending above and completely across the bed 3 carried by the traveling grate 4. Beams 136 carry spaced parallel cross members 138 of I-shaped cross section extending generally horizontally in the direction of travel of the hearth. Downwardly extending baffle members 139 and spacer members 140 of refractory material are carried by members 138. Members 138 and baffle members 139 are sufficient in number to cause the baffle and spacer members to extend essentially completely across the grate from sidewall to sidewall as shown in FIG. 10. Baffle members 139 are spaced from each other, are of such number, and their lower ends are sufficiently close to the top of the traveling bed 3 that little or no gas will escape across the top of the bed from one hood to the adjacent hood, the sealing means 135 providing a tortuous path through which the gases are required to pass.

Figure 11:
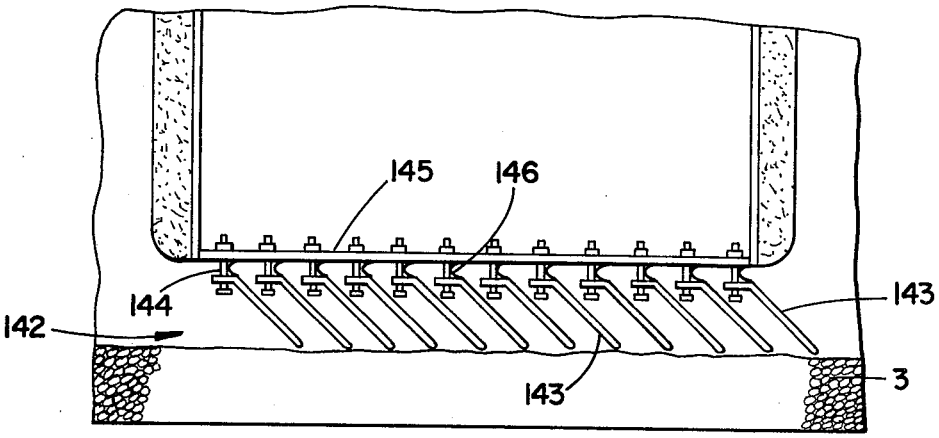
FIG. 11 is a sectional elevation of another form of sealing means that may be used above the grate and the bed thereon.
Figure 12:
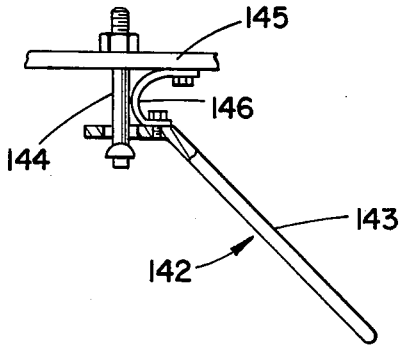
FIG. 12 is a fragmentary detail of one of the sealing elements of FIG. 11 but to a larger scale.

Alternately, if desired, the sealing means at the top of the bed between adjacent hoods may be means 142 of a drag-flapper type, illustrated schematically in FIGS. 11 and 12 in which sealing means comprises a large number of flexibly mounted vanes 143 each extending the full distance across the width of the hearth of the grate 4 between its side walls. The upper portions of these vanes are pivotally supported on upwardly extending members 144 such as the bolts illustrated, carried by a horizontal beam 145. The vanes may be made of sheet metal and be of generally rectangular shape and of a size such that the lower edge of each vane 143 lightly engages the top of the moving bed 3. Sealing means 142 includes flexible heat resistant sheets 146 to close the spaces between beam 145 and the vanes 143.

Transverse sealing means are also employed at the underside of the moving grate to reduce leakage of gas from the lower gas enclosures of the endmost treating zones, and between the lower gas enclosures of adjacent zones. Various types of sealing means may be employed for this purpose, such as that illustrated in FIG. 13.

Figure 13:
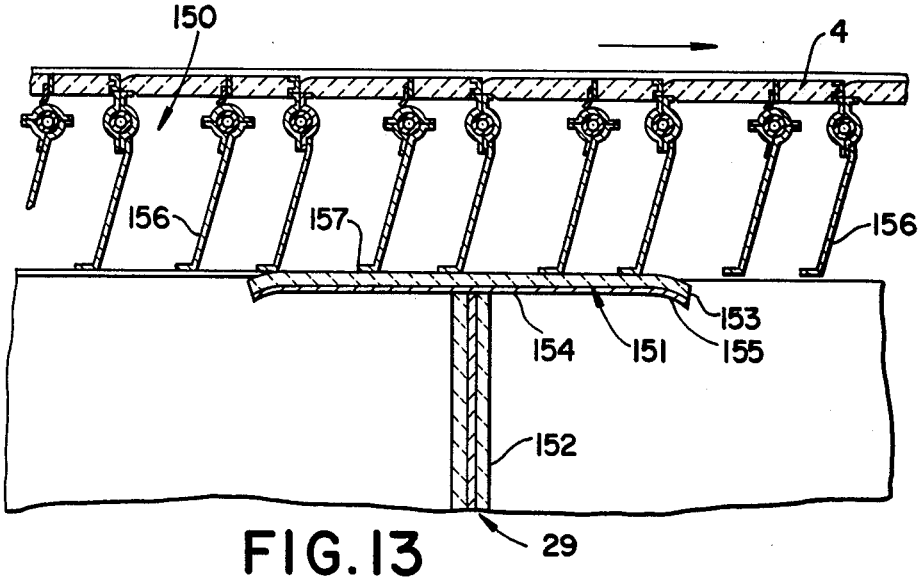
FIG. 13 is a cross sectional elevation of one of the sealing means that may be used below the grate to form a seal between the moving grate and two enclosures of adjacent zones below the grate.
Figure 14:
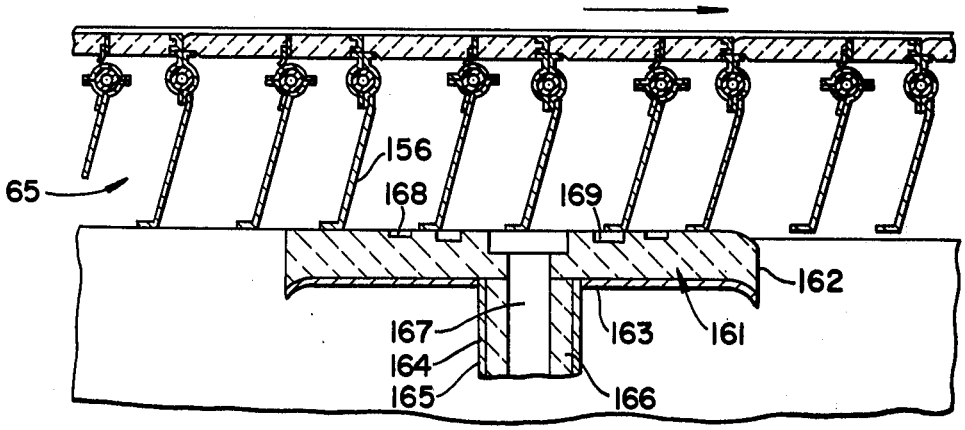
FIG. 14 is a fragmentary section to the same scale as FIG. 13 of another form of sealing means that may be used below the grate enclosures of adjacent hoods and to draw off leakage gas.

The seal 150 of FIG. 13 comprises a stationary horizontal plate 151 positioned on a partition 152 shown as forming part of the sealing portion 29 that separates adjacent gas enclosures 23 and 24. Plate 151 may be made up of an upper portion 153 of wear-resistant refractory material supported by a lower portion 154 of heat-resistant metal. Plate 151 extends completely across the width of the grate 4 and is fixed gas-tight to the sides of the gas enclosures as shown in FIG. 14. The front and rear edges 155 of the plate preferably slope downwardly. Downwardly extending flexible or flexibly mounted sealing vanes 156 are secured to the bottom of the grate 4. Each vane carries a flange 157 at its lower edge which slides across the upper surface of plate 151 to prevent lateral gas leakage. The spaced flanged vanes 156 which are preferably formed of heat resistant metal, extend across the plate 151 to provide an effective seal for preventing harmful gas flow between adjacent heating zones.

Sealing means 150 can be employed between all of the gas enclosures but is preferably replaced by a different sealing means 65 between enclosures 24 and 25 for zones B and C. Sealing means 65 may be of the labyrinth type of FIG. 13 or other type, adapted to minimize leakage of gases from one zone to another along the underside of the grate. In accordance with the present invention, suction is applied at an intermediate point within sealing means 65 so that the major portion of gases leaking through sealing means 65 can be recycled to the coke burn-off zone C (FIGS. 3, 5).

As shown in FIG. 14, the sealing means 65 comprises a stationary horizontal plate 161 having an upper refractory portion 162 supported by a lower metal portion 161. Plate 161 is positioned under the grate 4 and extends completely across the grate, its opposite ends being fixed in gas tight relation to the sidewalls of the gas enclosures. Plate 161 is adapted to be engaged by spaced flexible sealing vanes 156 to seal between adjacent gas enclosures, as in the sealing means of FIG. 13. The plate is rigidly supported on a vertical member 164 comprising an outer metal shell 165 and an inner refractory portion 166 having in it a suction passage 167 for conducting leakage gases away from the central portion of the plate 161. If desired, the upper refractory portion 162 of the sealing plate may be provided with shallow grooves 168, 169 extending across the plate to aid in providing a tortuous path for the gases. These passages are arranged to communicate with passage 167. Passage 167 is connected to conduit 63 (FIGS. 3, 5) provided for the purpose previously discussed. Other types of seals may be provided in place of sealing means 65, although it provides exceptional advantages.

In the apparatus discussed above, sealing means 150 are used below the grate in the sealing portions 28, 29, 31, 32 and 33 of FIG. 3 and also in sealing portion 106 of FIG. 5; sealing means 65 is used in sealing portion 30 between zones B and C. However, sealing means 65 may be used, if desired, provided suitable means is provided to draw off leakage gases.

Figure 15:
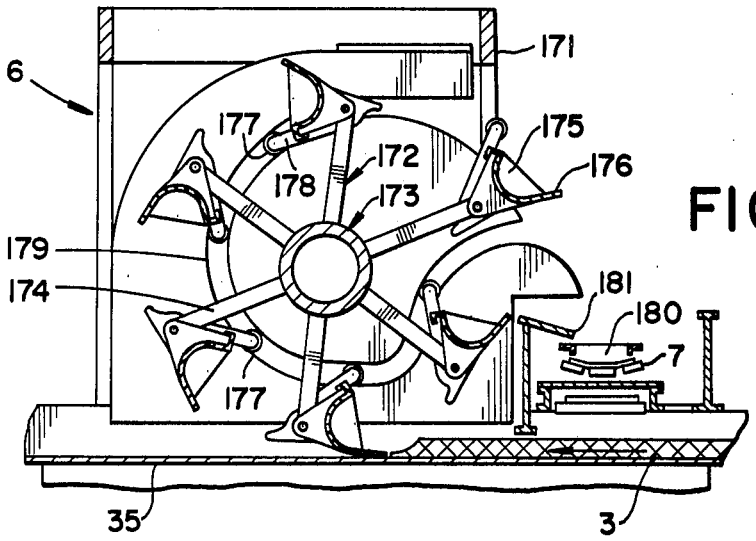
FIG. 15 is a fragmentary vertical section, to a scale larger than that of FIGS. 1, 2, and 4 but to a scale smaller than those of FIGS. 6 and 14, showing means for removing material from the grate at its discharge location, and for discharging the material onto a conveyor.

While part or all of the spent agglomerated pieces on the circular grate 4 may be removed from the grate and transferred to the charge conveyor means 7 by dumping or by pushing them off the grate, preferably in the illustrated apparatus discharge means 6 removes the pieces from the grate by lifting them off the grate, as by suitable apparatus such as that shown in FIG. 15 and disclosed in U.S. Pat. No. 3,460,818. The apparatus comprises a stationary frame 171 and a rotatable frame 172 carried by a power-driven shaft 173 mounted in frame 171 for rotation about a horizontal axis. The rotatable frame rigidly carries six pairs of spokes 174 which pivotally carry scoop members 175. Each scoop member is pivotally mounted on its associated pair of spokes and has a curved generally concave surface terminating in a leading edge 176. The scoop members are mounted so that, as frame 172 rotates, each scoop member 175 in its lowermost position faces with its concave surface the approaching material in bed 3 on the hearth 35 of the grate 4, engages the material, and scoops it off the hearth. The scoop members preferably extend from sidewall to sidewall of the grate to remove all of the material, but can extend part way across the grate to remove only a portion of the material and make possible spreading of the remaining material to form a hearth layer.

Means are provided for actuating the scoop members comprising rollers 177 mounted on arms 178 on the ends of the scoop members. The rollers travel in a stationary cam track 179 shaped to cause the leading edge 176 of each scoop member in the lowermost position to engage the material on the grate at the desired location, and then when such scoop member is raised to a position where its axis is approximately horizontal relative to the axis of the rotatable frame, to allow such scoop member to tilt and discharge the material it carries into a suitable conveyor 180 that extends above the grate and conducts the material away in a lateral direction deposit it on discharge conveyor 7. If desired, shielding means 181 may be provided to guide the material onto the conveyor. As each scoop member continues to move upwardly after dumping, its rollers re-enter the cam track.

To provide the agglomerated tar sand pieces with the strength required for commercial processing in a bed of substantial depth on a traveling grate and to prevent disintegration during heating of the bed, a small amount, such as 0.5 to 10 percent by weight of suitable agglomeration aiding material of the kind disclosed above is thoroughly mixed with the tar sand or other bituminous material before it is agglomerated into pieces.

In the course of the above disclosed process, agglomerated tar sand pieces in the bed are heated to an incipient fusion temperature of at least 2100° F. to cause sintering and a substantial increase in the strength of the pieces. In the coke burn-off zone C an oxidizing gas is employed, in which case the combustion of carbonaceous material in the coke or addition agent can produce the heat required for such sintering of the pieces as well as residual heat in the sintered agglomerates which is recovered in the process. The thus heat-hardened pieces then successfully withstand degradation during successive steps of the process.

In accordance with the present invention, the bed of agglomerated pieces is preferably heated to a temperature sufficient to glaze the surface of the pieces, such as 2400° F. or higher and for a period of time sufficient to provide glazed pellets of high strength. The resulting solid glazed agglomerated pieces of spent tar sand or other spent bituminous mineral resulting from the method of the invention is a commercially valuable material which can be used as a substitute for gravel or crushed stone. It can be conveyed, handled, stockpiled, used in land-fills, or used for erosion control. The glazing of the pieces solves dust control problems which otherwise could be serious.

It also reduces or eliminates water pollution. Tests show that glazed agglomerated spent pieces formed in accordance with the inventicn have very low solubility in water so that large stockpiles of such pieces can be exposed to weathering including rainfall with little if any danger of contaminating ground waters or streams.

Figure 16:
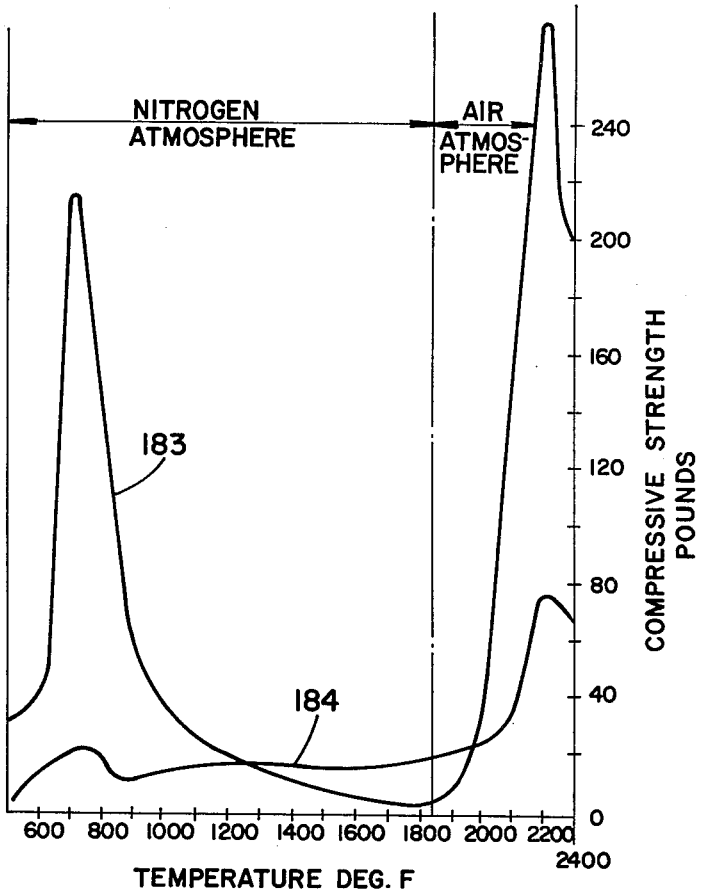
FIG. 16 graphically depicts the compressive strengths of pieces of agglomerated particulate bituminous hydrocarbon mineral material treated according to the invention.
Figure 17:
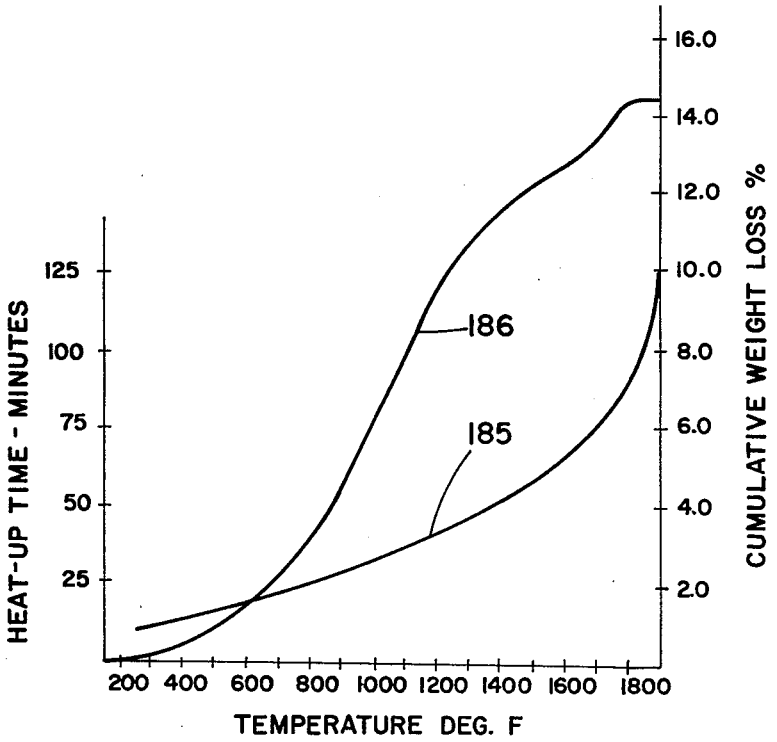
FIG. 17 graphically depicts temperature-weight loss and temperature-heat-up times for such pieces.

FIGS. 16 and 17 show curves illustrating characteristics of pieces of agglomerated hydrocarbon containing bituminous mineral material processed according to the invention.

The curves 183 and 184 of FIG. 16 depict cold compressive strengths of pieces that have been heated to various temperatures under conditions obtained in the process of the present invention. Curve 183 illustrates the cold compressive strengths at various temperatures of pieces of tar sand that had been formed, prior to heating, by compacting the tar sand under pressure, while curve 184 illustrates the cold compressive strengths of pieces of ore saturated diatomite that had been produced by balling prior to heating of the pieces.

These curves show that pieces of agglomerated particulate hydrocarbon containing mineral material of the type contemplated by the invention, whether produced by compression or by balling, have sufficient strength to permit them to be subjected to heating and treating conditions in processes embodying the present invention, and that after removal of the hydrocarbon portion of the material, the pieces have very substantial strengths due to the aforesaid sintering action.

FIG. 17 contains curve 185 depicting the relationship between heat-up time and temperature of the pieces of curve 183 of the preceding FIG. 16, while curve 186 of FIG. 17 illustrates the weight loss of such pieces at such temperatures, the weight loss arising principally from removal of the hydrocarbon portion of the material from the pieces.

The pieces of agglomerates of tar sand used in obtaining the information for curve 183 of FIG. 16 and curves 185 and 186 of FIG. 17 were made by compressing tar sand, as received from an Edna, Calif. tar sand deposit, under a force of 4800 pounds in a hydraulic press to produce pieces of cylindrical shape measuring $\frac{5}{8}$ inches in diameter and $\frac{5}{8}$ inches long.

Some of the pieces were made with additives to aid in agglomerating, which additives were lime hydrate, metallurgical coal, or oil bearing diatomite, in amounts of from 0.5 to 10%.

The pieces thus produced were placed in a nickel boat and inserted in a muffle furnace in which the temperature was raised as indicated by curve 185 and through which a slight flow of nitrogen gas was maintained during the heating. When each of several desired temperature levels was reached, the temperature was maintained for a period of 5 minutes. At each such level, a single piece was removed, cooled in nitrogen, and retained for compressive strength determination. Other pieces were heated up to a temperature of 1850° F. in nitrogen and heated in air to temperatures up to 2400° F., cooled in air, and set aside for compressive strength determinations.

The cooled pieces that had been heated various temperatures up to 1850° F. and cooled in nitrogen, and those heated in air up to 2400° F. and cooled, were then subjected to compressive strength determinations by applying a load by a constant rate on the flat ends of the cylinder until fracture occurred, with the pounds of load recorded at a strain rate of 2.1 inches per minute. strength determinations are illustrated by curve 183 of FIG. 16 which is a composite curve of several tests made with compressed tar sand pieces using the additives mentioned above as well as no additives.

Several tests were performed on compacted tar sand pieces in a stainless retort for determining the rate of weight loss. For each test a two-layer bed of the pieces was placed in the retort, the unit sealed and placed in the furnace. This retort assembly was suspended from a balance with the weight loss recorded at 5-minute intervals as the temperature was raised 1850° F. The weight losses are depicted on curves 186 of FIG. 17 and the heating time is also depicted on curve 185 of that Figure.

Oil saturated diatomite material from a Kern County, Calif. deposit was formed into pieces by compacting in a hydraulic press as before, and also into other pieces by balling by a process in which the diatomite was received was shredded to produce a consistency suitable for balling and the thus prepared material fed into a balling device with a fine spray of water to form green balls of between about $\frac{1}{2}$ inch to $\frac{3}{8}$ inch in diameter.

Both the diatomite pieces produced by compression and the diatomite pieces produced by balling were then subjected to a series of tests similar to those described above. Results of weight losses and heat-up times were similar to those shown in FIG. 17.

Compressive strength tests made on the pieces produced by compacting were carried out in a manner similar to that described above, and the results were similar to those shown in curve 183 of FIG. 16. Compressive strength tests were made on diatomite pieces made by balling, in a manner similar to that described above, at strain rate of 2.1 inches per minute and plotted as curve 184 of FIG. 16.

As shown in FIG. 16, the pieces of hydrocarbon containing material, whether tar sand or oil saturated diatomite, produced either by pressure or by balling, have adequate strength to remain whole during the process of the invention, and when the spent pieces from which the hydrocarbon portion of the material such as bitumen has been largely if not entirely removed are heated to high temperatures on the order of 2100° F. to 2300° F. their strength increases very substantially so as to cause them to be useful for the purposes indicated above. These tests evidence the advantages and utility of the processes of the invention and the products resulting therefrom.

It is apparent that various modifications other than those indicated above may be made in the processes and apparatus disclosed above as embodying the invention. For example, the invention may be used for the purpose of extracting useful products such as liquid fuels and gases from particulate hydrocarbon containing, preferably bituminous, mineral materials other than those specifically mentioned above. Therefore, while the invention has been disclosed above with respect to specific embodiments thereof, this is intended for the purpose of illustration rather than limitation and other variations and modifications of the disclosed embodiments will be apparent to those skilled in the art, all within the intended spirit and scope of the invention. Accordingly, the patent is not to be limited to the specific embodiments herein disclosed nor in any other way that is inconsistent with the extent to which the progress in the art has been advanced by the invention.

What is claimed is:

1. A process for recovering oil and fuel gases from particulate bituminous tar sand comprising agglomerating the particulate tar sand to form discrete pieces of substantial strength, conveying said pieces to a traveling gas permeable grate, said grate having a charging location at which said pieces are deposited on the grate and a discharge location at which spent pieces are removed from the grate, forming on said grate at said charging location a gas permeable bed of said pieces of substantial depth, moving said grate between said charging location and said discharge location to move the pieces in said bed sequentially through a series of separate zones for sequential treatment of the pieces in said bed, said zones including a distillation zone and a coke burn-off zone, passing heated gas through said bed and said grate in said distillation zone to heat the bed to an oil-educting temperature of at least 750° F. to form coke between the sand particles of said pieces in said distillation zone, cooling the hot gases leaving said distillation zone to condense the thus educted oil and to separate oil from said gases, removing and collecting hydrocarbon gases produced in said distillation zone, moving the traveling grate carrying the bed of oil-depleted coke-containing sand from said distillation zone through said coke burn-off zone while passing hot oxidizing gas through said bed and said grate in said coke burn-off zone to cause combustion of the coke, cooling the spent sand pieces leaving said coke burn-off zone by transferring heat from said spent sand pieces to cooled gas leaving said distillation zone, and passing the thus heated gas to said distillation zone, and removing the spent sand pieces from said grate at said discharge location, said agglomerated pieces having sufficient strength to form said bed and to withstand treatments in said zones without substantial breakage of said pieces, and the conditions in said coke burn-off zone being such as to cause said pieces to sinter in said zone.

2. The process of claim 1 wherein a portion of the hydrocarbon gases recovered from said distillation zone is continuously recycled through the bed of pieces of the grate in said distillation zone.

3. The process of claim 1 wherein steam is contacted with the bed after it leaves said coke burnoff zone to produce water gas.

4. The process of claim 1 wherein the particulate tar sand is mixed with from about 0.5 to about 10 percent by weight of an agglomeration aiding agent before being formed into said pieces and said pieces are heated to a temperature of at least about 2100° F. in said coke burn-off zone.

5. The process of claim 1 in which preheated air is supplied to said coke burn-off zone for combustion purposes, and in which said air is preheated by direct transfer of heat to said air from hot combustion gases emanating from said coke burn-off zone.

6. A process for recovering oil and fuel gases from particulate bituminous tar sand without treatment to separate it from sand not containing bitumen comprising agglomerating the particulate tar sand to form discrete pieces of sufficient strength to form said bed and to permit subsequent processing without substantial breakage, continually feeding said pieces to a traveling gas permeable grate to form on said grate a gas-permeable bed of said pieces of substantial depth, said grate having a charging location where said pieces are fed onto said grate and a discharge location where the spent pieces are removed from said grate, the portion of the grate between the charging location and the discharge location being divided into a series of zones through which said grate passes to move said bed for sequential treatment of the material of the bed, each zone having enclosure means in which hot gas is passed upwardly or downwardly through the moving bed of material and said grate, said zones including a distillation zone, a coke burn-off zone, and recycle gas heater zone, moving said material in said bed through said distillation zone while passing heated gas transversely through the bed and said grate to educt oil from said material and to form coke, cooling the hot hydrocarbon gas leaving said distillation zone to condense the educted oil, moving the oil-depleted coke-containing material in said bed from said distillation zone through said coke burn-off zone while passing oxidizing gas transversely through the permeable bed and said grate to cause combustion of the coke, thereafter moving the bed from said burn-off zone through said recycle gas heater zone while recycling said cooled hydrocarbon gases tranvsversely through the bed and said grate to preheat said hydrocarbon gases and to cool the material in the bed, recycling said thus heated gases through said distillation zone while at a temperature sufficient for oil-eduction from and coking of material passing through said zone, removing the spent pieces from the grate at said discharge location, and continually removing and collecting hydrocarbon gases produced in said distillation zone, said agglomerated pieces having sufficient strength to form said bed and to withstand treatments in said zones without substantial breakage of said pieces, and the conditions in said coke burn-off zone being such as to cause said pieces to sinter in said zone.

7. The process of claim 6 in which said grate is a circular grate moving about an upright axis.

8. The process of claim 6 wherein the particulate tar sand is mixed with from about 0.5 to about 10 percent by weight of an agglomeration-aiding agent before being agglomerated into said pieces.

9. The process of claim 6 in which said pieces are subjected in said coke burnoff zone to a temperature of from 1850° F. to 2400° F. sufficient to sinter the particulate material in said pieces to form agglomerates of substantial strength.

10. The process of claim 7 in which substantially all of the heat required to recover fuel from said material is produced by combustion of residual oil and coke in said coke burnoff zone.

11. The process of claim 6 in which preheated air is supplied to said coke burn-off zone for combustion purposes, and in which said air is preheated by direct transfer of heat to said air from hot combustion gases emanating from said coke burn-off zone.

12. The process of claim 6 in which steam is contacted with the material in a gasification zone, after the material leaves said coke burnoff zone, to produce water gas containing carbon monoxide and hydrogen by reaction of steam with coke remaining in the material, the material being at a temperature of at least about 1200° F. in said gasification zone.

13. The process of claim 7 in which said distillation zone is adjacent to and precedes said coke burnoff zone and a transverse seal is provided between said zones, and in which a subambient pressure is applied at said seal to withdraw gas leaking between said zones, said gas being directed to said coke burnoff zone.

14. The process of claim 12 in which steam is contacted with said material in said gasification zone following said coke burning zone while said material is in said bed on the grate.

15. A process for recovering oil and fuel gases from particulate natural bituminous tar sand comprising agglomerating the particulate tar sand to form discrete pieces of high strength, conveying said pieces to a traveling gas permeable grate, said grate having a charging location at which said pieces are deposited on the grate and a discharge location at which spent pieces are removed from the grate, forming on said grate at said charging location a gas permeable bed of said pieces of substantial depth, moving said grate between said charging location and said discharge location to move the pieces in said bed sequentially through a series of separate zones for sequential treatment of the pieces in said bed, said zones including a distillation zone and a coke burn-off zone, passing heated gas through said bed and said grate in said distillation zone to heat the bed to an oil-educting temperature to form coke between the sand particles of said pieces in said bed and cause oil bearing gases to leave said pieces in said coking zone, cooling the hot gases leaving said distillation zone to condense the thus educted oil and to separate oil from said gases, removing and collecting hydrocarbon gases produced in said distillation zone, moving the traveling grate carrying the bed of oil-depleted coke-containing sand from said distillation zone through said coke burn-off zone while passing hot oxidizing gas through said bed and said grate in said coke burn-off zone to cause combustiion of the coke, cooling the spent sand pieces leaving said coke burn-off zone by transferring heat from said spent sand pieces to said cooled gas leaving said distribution zone, and passing the thus heated gas to said distillation zone, and removing the spent sand pieces from said grate at said discharge area, said agglomerated pieces having sufficient strength to form said bed and to withstand treatments in said zones without substantial breakage, and the conditions in said coke burn-off zone being such as to cause said pieces to sinter in said zone.

16. The process of claim 15 wherein the particulate tar sand is mixed with from about 0.5 to about 10 percent by weight of an agglomeration-aiding agent before being agglomerated into said pieces.

17. The process of claim 15 wherein said grate is a circular grate traveling about a central upright axis.

18. The process of claim 15 in which preheated air is supplied to said coke burn-off zone for combustion purposes, and in which said air is preheated by direct transfer of heat to said air from hot combustion gases emanating from said coke burn-off zone.

19. The process of claim 17 wherein said pieces are heated in said coke burn-off zone to an incipient fusion temperature of at least 2100° F.

20. The process of claim 17 wherein substantially all of the heat energy required for said process is generated in said coke burn-off zone.

21. The process of claim 17 wherein a gasification zone is provided on said circular grate at the discharge end of said coke burn-off zone and steam is passed through the bed and said grate in said gasification zone to produce a hydrogen-rich gas.

22. The process of claim 17 wherein a transverse seal is provided between said distillation zone and said coke burn-off zone, and a subambient pressure is applied at said seal to withdraw gas leaking between said zones.

23. The process of claim 19 wherein said bed is heated in said coke burn-off zone to form a glazed surface on said pieces.

24. The process of claim 23 wherein said pieces are heated to a temperature of at least 2400° C.

25. A process of the character described for recovering oil and fuel gases from particulate hydrocarbon-containing mineral ore without treatment to separate it from material not containing hydrocarbon comprising agglomerating the material to form strong discrete pieces, continually feeding said pieces to a gas permeable circular traveling grate to form on said grate a gas-permeable bed of substantial depth, said grate having a charging location where said pieces are fed onto said grate and a discharge location where spent pieces are removed from said grate, the portion of the circular grate between the charging location and the discharge location being divided into a series of zones through which said grate passes to move said bed for sequential treatment of the material of the bed, each zone having enclosure means in which hot gas is passed upwardly or downwardly through the moving bed of material and said grate, said zones including a distillation zone, a coke burn-off zone, and a recycle gas heater zone, moving said material in said bed through said distillation zone while passing recycled heated gas transversely through the bed and said grate to educt oil from said material and to form coke between particles of said material, cooling the hot hydrocarbon gas leaving said distillation zone to condense the educted oil and to separate oil from said hydrocarbon gas, moving the oil-depleted coke-containing material in said bed from said distillation zone through said coke burn-off zone while passing oxidizing gas transversely through the permeable bed and said grate to cause combustion of the coke and sintering of said pieces, heating said oxidizing gases passing through said material in said coke burn-off zone to a temperature sufficient to maintain combustion of the coke in said burn-off zone, thereafter moving the bed from said coke burn-off zone through said recycle gas heater zone while recycling said cooled hydrocarbon gases transversely through the bed and said grate to heat said hydrocarbon gases and to cool the hot material in the bed, recycling said thus heated gases through said distillation zone while at a temperature sufficient for oil-eduction from and coking of material passing through said distillation zone, removing the material from the grate at said discharge location, and continually removing and collecting hydrocarbon gases produced in said distillation zone, said agglomerated pieces having sufficient strength to form said bed and to withstand treatments in said zones without substantial breakage.

26. The process of claim 25 in which preheated air is supplied to said coke burn-off zone for combustion purposes, and in which said air is preheated by direct transfer of heat to said air from hot combustion gases emanating from said coke burn-off zone.

* * * * *

UNITED STATES PATENT AND TRADEMARK OFFICE

CERTIFICATE OF CORRECTION

PATENT NO. : 4,200,517

DATED : April 29, 1980

INVENTOR(S) : Franklin S. Chalmers, Charles A. Czako and Carl J. Nelson

It is certified that error appears in the above-identified patent and that said Letters Patent are hereby corrected as shown below:

Column 4, line 42, delete "dimensional"

Column 7, line 61, before "recovering" change "the" to --thus--.

Column 11, line 9, change "ing" to --ion--; line 33, for "nozzle" substitute --nozzles--.

Signed and Sealed this

*First* Day of *July 1980*

[SEAL]

*Attest:*

SIDNEY A. DIAMOND

*Attesting Officer*

*Commissioner of Patents and Trademarks*